US008157592B2

(12) United States Patent
Mizukami et al.

(10) Patent No.: US 8,157,592 B2
(45) Date of Patent: Apr. 17, 2012

(54) CONNECTOR FOR TRANSFERRING HIGH FREQUENCY SIGNALS

(75) Inventors: Kazuhiro Mizukami, Tokyo (JP); Toshihiro Kusagaya, Tokyo (JP)

(73) Assignee: Fujitsu Component Limited, Tokyo (JP)

( * ) Notice: Subject to any disclaimer, the term of this patent is extended or adjusted under 35 U.S.C. 154(b) by 0 days.

(21) Appl. No.: 13/089,386

(22) Filed: Apr. 19, 2011

(65) Prior Publication Data

US 2011/0294356 A1 Dec. 1, 2011

(30) Foreign Application Priority Data

May 31, 2010 (JP) ..... 2010-124144

(51) Int. Cl.
*H01R 13/648* (2006.01)

(52) U.S. Cl. ..... 439/607.07

(58) Field of Classification Search ..... 439/607.07, 439/607.05, 607.06, 79, 608, 660, 701
See application file for complete search history.

(56) References Cited

U.S. PATENT DOCUMENTS

| | | | | |
|---|---|---|---|---|
| 4,881,905 | A * | 11/1989 | Demler et al. | 439/79 |
| 5,160,273 | A * | 11/1992 | Carney | 439/108 |
| 5,433,618 | A * | 7/1995 | Morlion et al. | 439/108 |
| 5,549,481 | A * | 8/1996 | Morlion et al. | 439/108 |
| 5,741,144 | A * | 4/1998 | Elco et al. | 439/101 |
| 6,379,165 | B1 * | 4/2002 | Lee | 439/108 |
| 6,478,631 | B1 * | 11/2002 | Dutton et al. | 439/707 |
| 6,565,387 | B2 * | 5/2003 | Cohen | 439/607.06 |
| 6,612,869 | B1 * | 9/2003 | Billman | 439/607.07 |
| 6,648,689 | B1 * | 11/2003 | Billman et al. | 439/607.07 |
| 6,652,319 | B1 * | 11/2003 | Billman | 439/607.07 |
| 6,663,427 | B1 * | 12/2003 | Billman et al. | 439/607.07 |
| 6,682,369 | B1 * | 1/2004 | Korsunsky et al. | 439/607.07 |
| 6,692,305 | B2 * | 2/2004 | Nelson et al. | 439/607.07 |
| 6,986,682 | B1 * | 1/2006 | Jeon | 439/607.07 |
| 7,044,794 | B2 * | 5/2006 | Consoli et al. | 439/607.07 |
| 7,553,190 | B2 * | 6/2009 | Laurx et al. | 439/607.07 |
| 7,841,900 | B2 * | 11/2010 | Liu et al. | 439/607.07 |
| 7,931,474 | B2 * | 4/2011 | Laurx et al. | 439/65 |
| 7,950,963 | B2 * | 5/2011 | Mizukami et al. | 439/607.07 |
| 7,976,340 | B1 * | 7/2011 | Saraswat et al. | 439/607.07 |
| 2002/0048995 | A1 * | 4/2002 | Shindo | 439/608 |
| 2002/0098738 | A1 * | 7/2002 | Astbury et al. | 439/608 |
| 2002/0168898 | A1 * | 11/2002 | Billman et al. | 439/608 |
| 2003/0119362 | A1 * | 6/2003 | Nelson et al. | 439/608 |
| 2003/0162441 | A1 * | 8/2003 | Nelson et al. | 439/608 |
| 2003/0220018 | A1 * | 11/2003 | Winings et al. | 439/608 |
| 2003/0220019 | A1 * | 11/2003 | Billman et al. | 439/608 |
| 2003/0220020 | A1 * | 11/2003 | Billman | 439/608 |
| 2007/0155241 | A1 * | 7/2007 | Lappohn | 439/608 |
| 2009/0291593 | A1 * | 11/2009 | Atkinson et al. | 439/607.06 |

FOREIGN PATENT DOCUMENTS

| | | |
|---|---|---|
| JP | 2008-209305 | 9/2008 |

* cited by examiner

*Primary Examiner* — Tulsidas C Patel
*Assistant Examiner* — Vladimir Imas
(74) *Attorney, Agent, or Firm* — IPUSA, PLLC

(57) ABSTRACT

A connector includes a first connector member configured to arrange a plurality of plane first boards with gaps in a thickness direction of the first boards, the first board including a conductive layer and an insulation layer, the insulation layer having a surface where a first signal pattern is formed; and a second connector member configured to arrange a plurality of plane second boards with gaps in a thickness direction of the second boards, the second board including a conductive layer and an insulation layer, the insulation layer having a surface where a second signal pattern is formed.

6 Claims, 14 Drawing Sheets

CONNECTOR FOR TRANSFERRING HIGH FREQUENCY SIGNALS

CROSS-REFERENCE TO RELATED APPLICATIONS

This patent application is based upon and claims the benefit of priority of Japanese Patent Application No. 2010-124144 filed on May 31, 2010, the entire contents of which are incorporated herein by reference.

BACKGROUND OF THE INVENTION

1. Field of the Invention

The present invention generally relates to connectors configured to transfer a high frequency signal. More specifically, the present invention relates to a connector configured to reduce insertion loss at a high frequency band.

2. Description of the Related Art

A connector including a wiring board having a three layer structure where an insulation layer is formed on a metal plate and a wiring pattern is formed on the insulation layer has been suggested by inventors of the present invention. See, for example, Japanese Laid-Open Patent Application Publication No. 2008-209305.

FIG. 1 is a perspective view showing a structure of a related art wiring board 50 having a three layer structure, the wiring board 50 being included in the above-mentioned connector. The wiring board 50 has a three layer structure formed of a metal plate 51 made of phosphor bronze or the like, an insulation layer 52 made of polyimide or the like, and a wiring pattern 53 made of Cu, Al, or the like. A contact 54, including ground contacts 54G (54G1 through 54G4) and signal contacts 54S, extends from an edge part of these three layers.

The contact 54 has a main body similar to that of the wiring board 50, which has a three layer structure formed of the metal plate 51, the insulation layer 52, and the wiring pattern 53. The ground contact 54G1 which is one of the ground contacts 54G includes a ground wiring pattern 53G1. The ground wiring pattern 53G1 is connected to the metal plate 51 via a piercing hole 55G1. A pair of signal contacts 54S1 and 54S2 among the signal contacts 54S include signal wiring patterns 53S1 and 53S2 extending toward an edge part in a Z2 direction on the wiring board 50. The other ground contacts 54G2 through 54G4 and other signal contacts 54S3 through 54S8 have substantially the same structures.

In addition, the ground contacts 54G are provided so as to sandwich pairs of the signal contacts 54S in a Z1-Z2 direction. For example, a pair of signal contacts 54S1 and 54S2 is provided between the ground contact 54G1 and the ground contact 54G2. In the wiring board 50, the wiring pattern 53 of each of the contacts 54 is made to elastically come in contact with a wiring pattern of a corresponding wiring body (not illustrated in FIG. 1) provided separately, where the wiring patterns are electrically connected to each other.

SUMMARY OF THE INVENTION

Accordingly, embodiments of the present invention may provide a novel and useful connector solving one or more of the problems discussed above.

More specifically, the embodiments of the present invention may provide a connector configured to reduce insertion loss in a case where a wiring board having a three layer structure is connected to another wiring board.

Another aspect of the embodiments of the present invention may be to provide a connector, including:

a first connector member configured to arrange a plurality of plane first boards with gaps in a thickness direction of the first boards, the first board including a conductive layer and an insulation layer, the insulation layer having a surface where a first signal pattern is formed; and a second connector member configured to arrange a plurality of plane second boards with gaps in a thickness direction of the second boards, the second board including a conductive layer and an insulation layer, the insulation layer having a surface where a second signal pattern is formed;

wherein the first board of the first connector member, by connecting the first connector member and the second connector member to each other, makes the first signal pattern provided on a surface of a contact extending from an edge at a side facing the second connector member toward the second connector member come in contact with the second signal pattern provided on a surface of one of the plural second boards of the second connector member, and makes the conductive layer provided at a head end of the contact come in contact with the conductive layer of another one of the plural second boards.

Another aspect of the embodiments of the present invention may be to provide a connector, including:

a first connector member having a plane first board, the first board including a conductive layer and an insulation layer, the insulation layer having a surface where a first signal pattern is formed; and a second connector member having a plane second board and a conductive board, the second board including a conductive layer and an insulation layer, the insulation layer having a surface where a second signal pattern is formed;

wherein the first board of the first connector member, by connecting the first connector member and the second connector member to each other, makes the first signal pattern provided on a surface of a contact extending from an edge at a side facing the second connector member toward the second connector member come in contact with the second signal pattern provided on a surface of the second board of the second connector member, and makes the conductive layer provided at a head end of the contact come in contact with the conductive board of the second connector member.

According to the embodiment of the present invention, it is possible to provide a connector configured to reduce insertion loss in a case where a wiring board having a three layer structure is connected to another wiring board.

Additional objects and advantages of the embodiments are set forth in part in the description which follows, and in part will become obvious from the description, or may be learned by practice of the invention. The object and advantages of the invention will be realized and attained by means of the elements and combinations particularly pointed out in the appended claims. It is to be understood that both the foregoing general description and the following detailed description are exemplary and explanatory and are not restrictive of the invention as claimed.

DETAILED DESCRIPTION OF THE PREFERRED EMBODIMENTS

A description is given below, with reference to the FIG. 2 through FIG. 14 of embodiments of the present invention.

Figure 1:
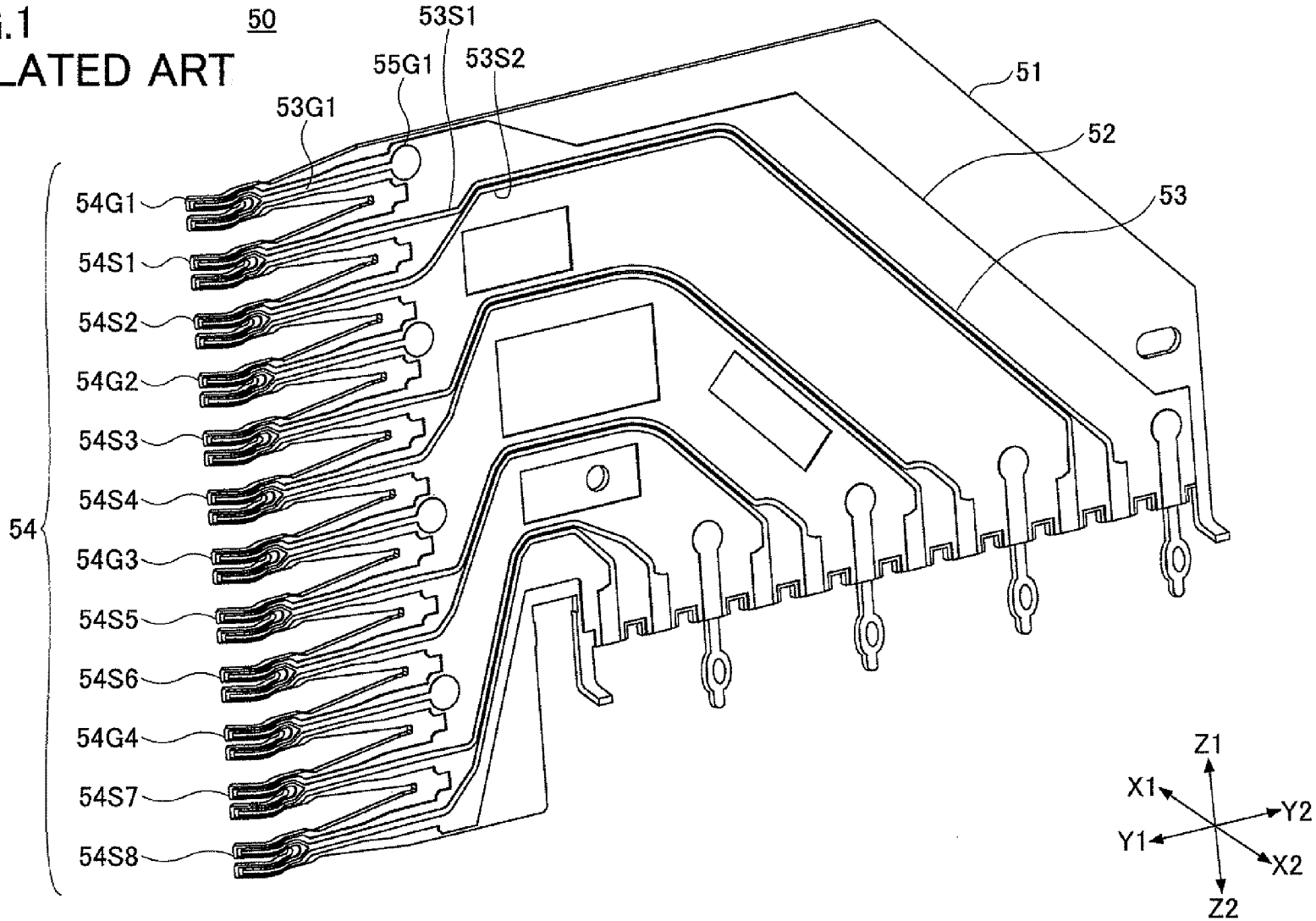
FIG.1 RELATED ART
FIG. 1 is a perspective view showing a structure of a related art wiring board having a three layer structure.
Figure 2:
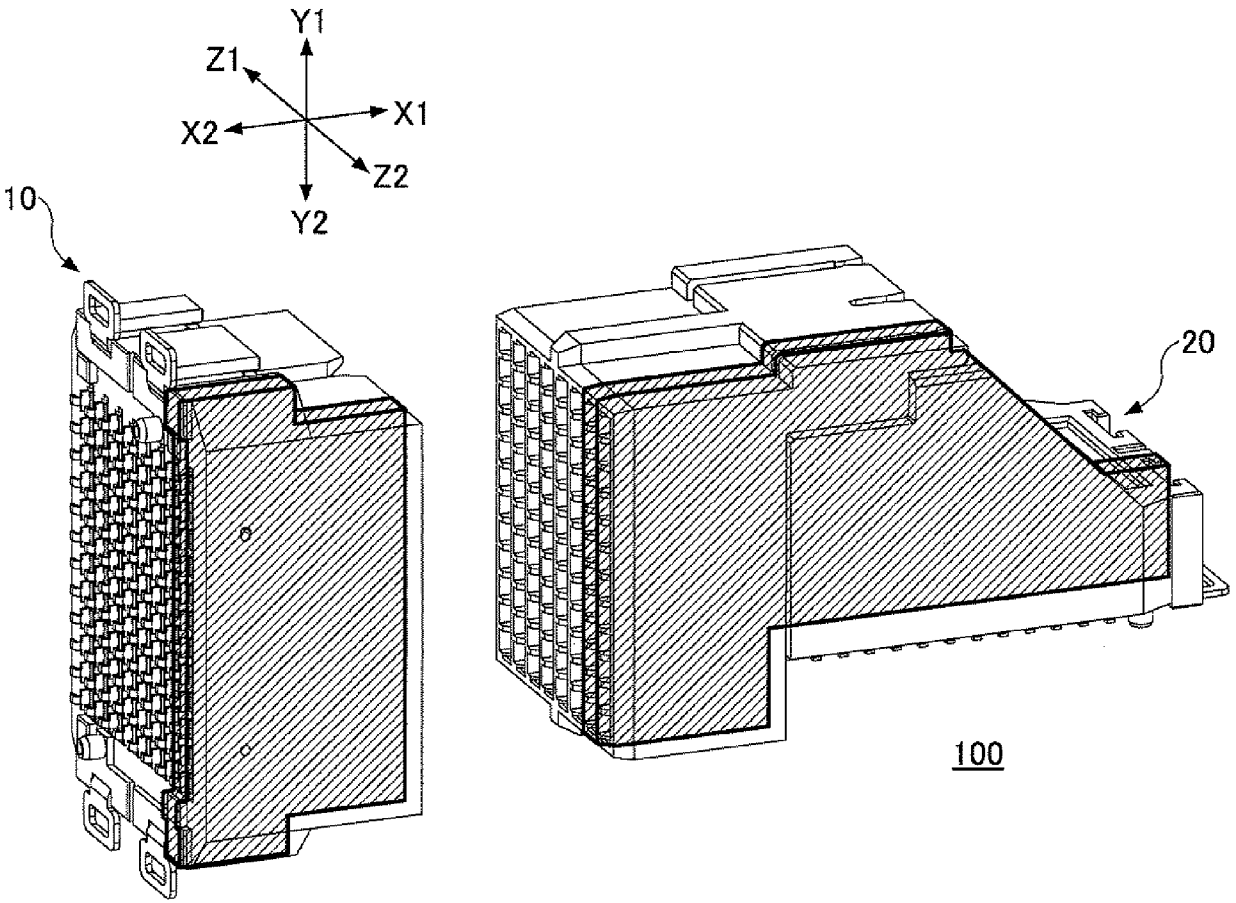
FIG. 2 is an exploded perspective view of a connector of an embodiment of the present invention.

FIG. 2 is an exploded perspective view of a connector 100 of an embodiment of the present invention. The connector 100 is, for example, a differential transmission type high speed transmission connector. The connector 100 includes a backplane board side jack connector 10 and a system board side plug connector 20.

Figure 3:
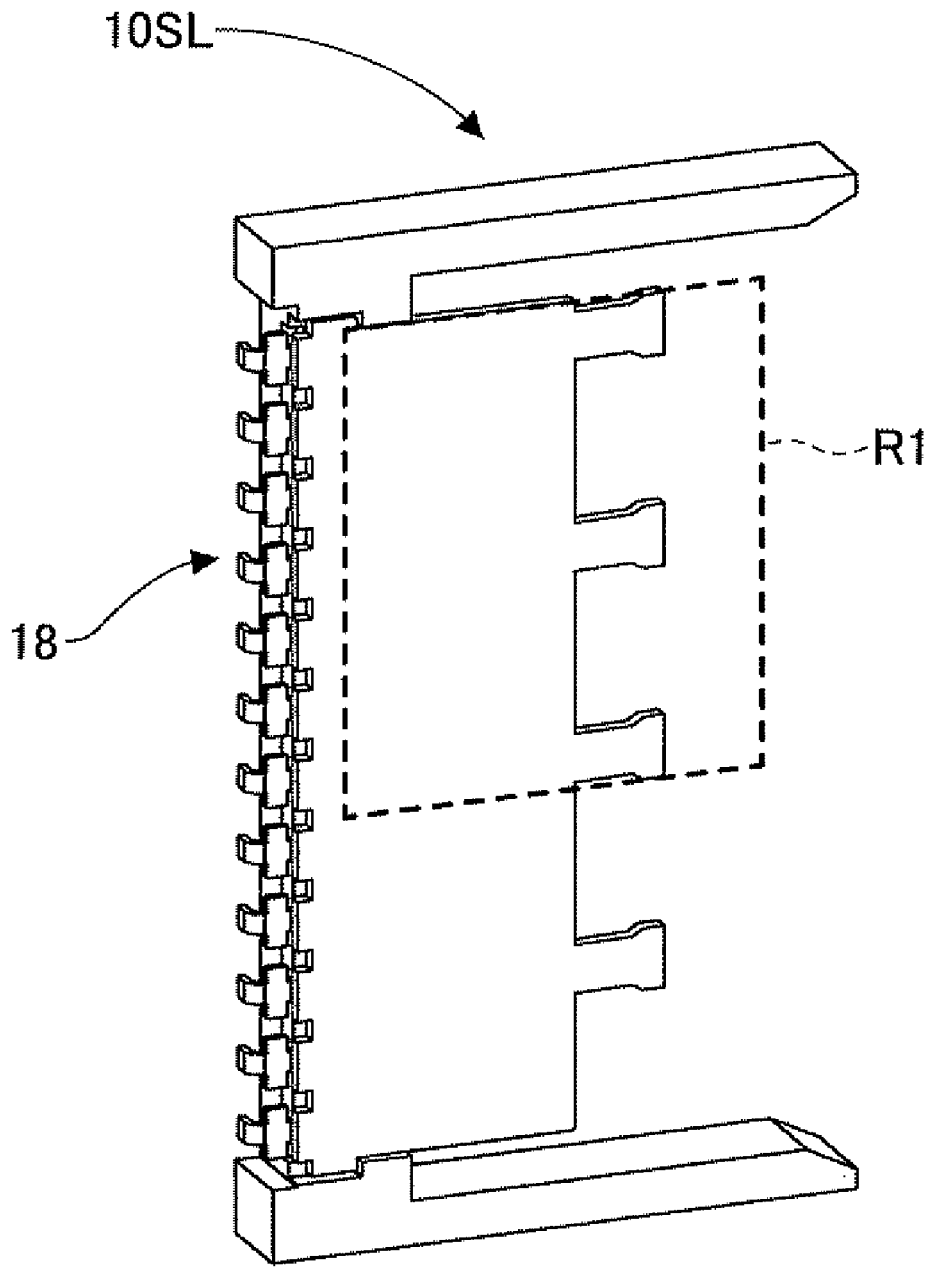
FIG. 3 is a perspective view showing a jack connector slice.
Figure 4:
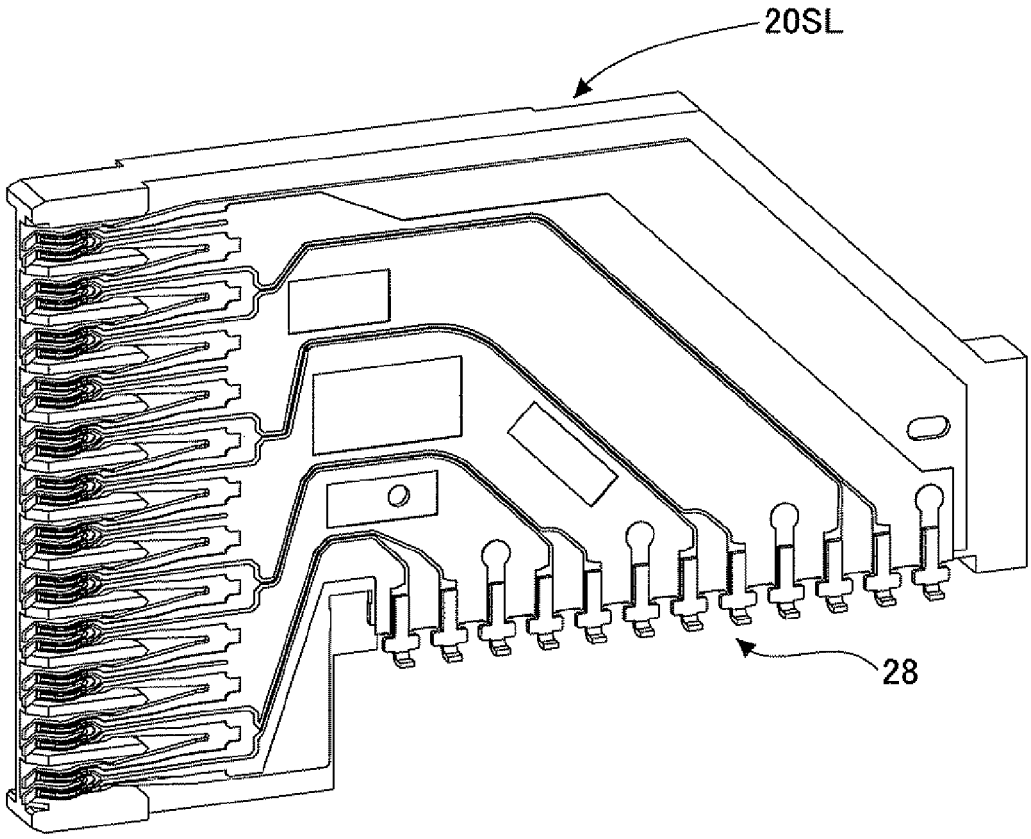
FIG. 4 is a perspective view showing a plug connector slice.
Figure 5:
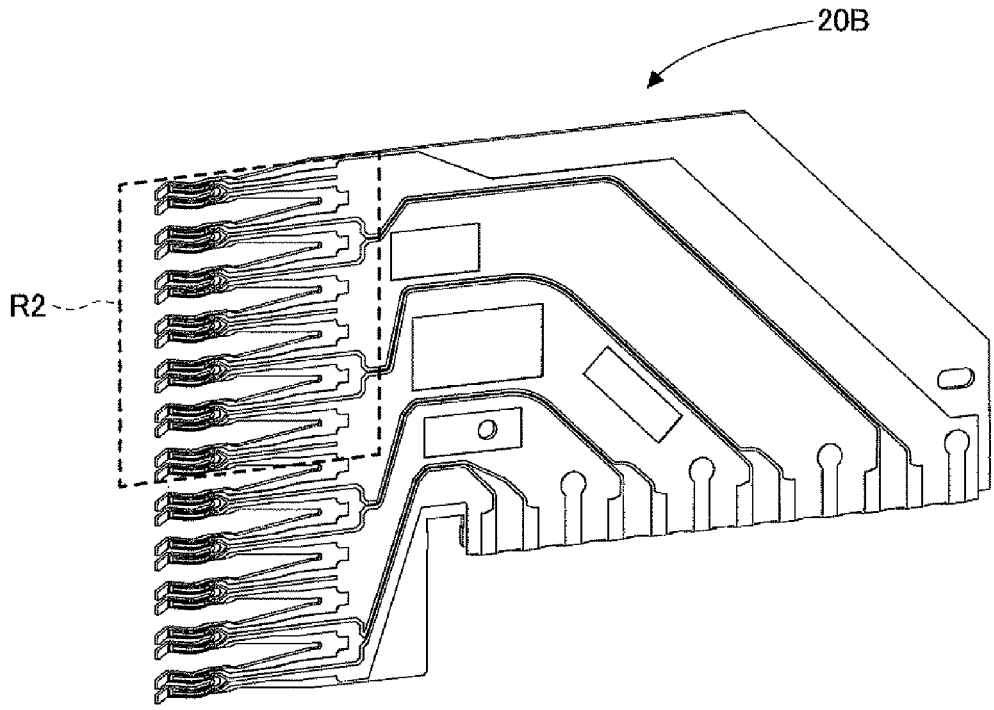
FIG. 5 is a perspective view showing a piece of blade included in the plug connector slice.

FIG. 3 is a perspective view showing a jack connector slice 10SL which corresponds to a slash line part of the backplane board side jack connector 10 shown in FIG. 2. Similarly, FIG. 4 is a perspective view showing a plug connector slice 20SL which corresponds to a slash line part of the system board side plug connector 20 shown in FIG. 2. FIG. 5 is a perspective view showing a piece of blade 20B included in the plug connector slice 20SL.

As shown in FIG. 2, the backplane board side jack connector 10 has a structure where plural (eight in this embodiment) jack connector slices 10SL are arranged in a Z1-Z2 direction. Each of the jack connector slices 10SL may be formed as a module structure which can be exchanged and which has the same function. As shown in FIG. 3, the backplane board side jack connector 10 is connected to a backplane board (not illustrated in FIG. 3) via a lead part 18 of each of the jack connector slices 10SL by using solder or a conductive adhesive.

In addition, as shown in FIG. 2, the system board side plug connector 20 has a structure where plural (eight in this embodiment) plug connector slices 20SL (see FIG. 4) are arranged in a Z1-Z2 direction. The plug connector slices 20SL may be formed as module structures which can be exchanged and which have the same function. As shown in FIG. 4, the system board side plug connector 20, as well as the backplane board side jack connector 10, is connected to a system board (not illustrated in FIG. 4) via a lead part 28 connected to blades 20B of each of the plug connector slices 20SL by using solder or a conductive adhesive.

Figure 6:
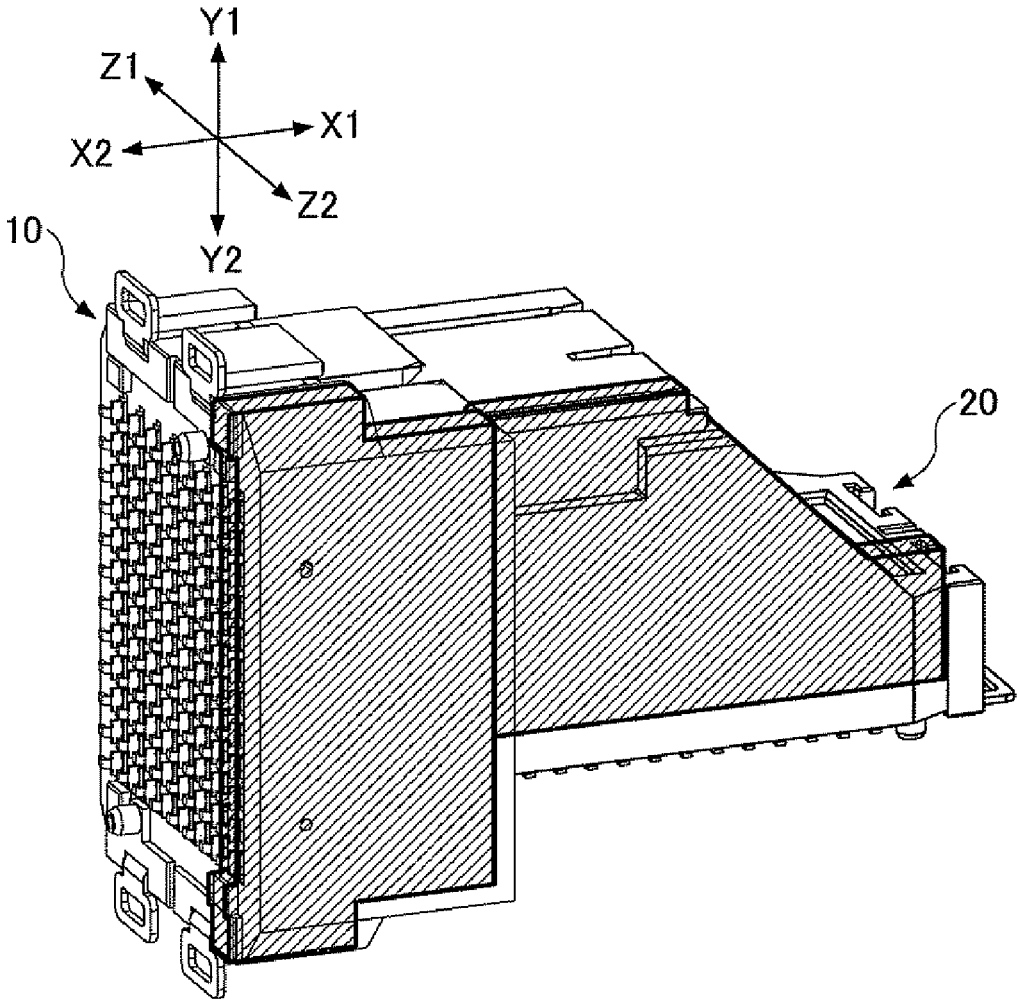
FIG. 6 is an assembly perspective view of a connector of the embodiment of the present invention.
Figure 7:
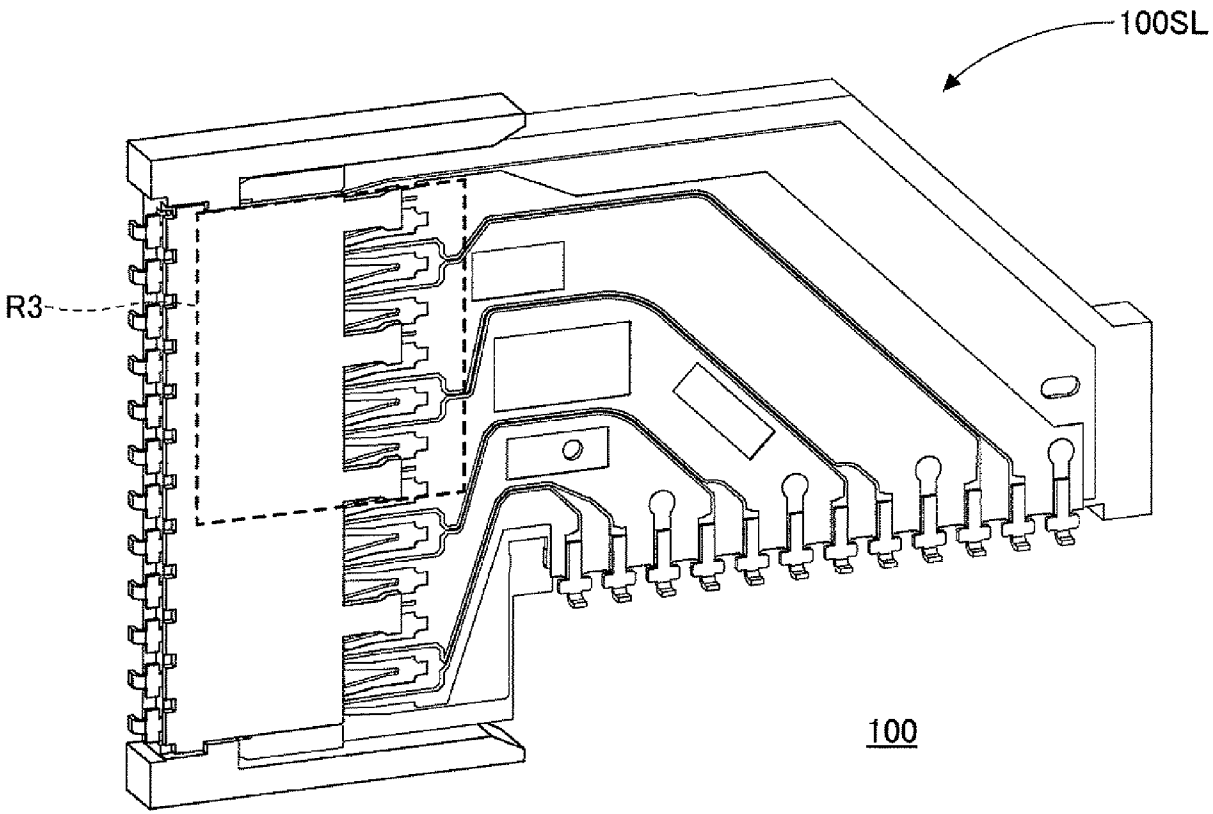
FIG. 7 is a perspective view showing a connector slice.

FIG. 6 is an assembly perspective view of the connector 100 of the embodiment of the present invention. FIG. 6 shows a state where the system board side plug connector 20 is inserted in the backplane board side jack connector 10. FIG. 7 is a perspective view showing a connector slice 100SL which corresponds to a slash line part of the connector 100 shown in FIG. 6. The connector slice 100SL is formed by combining the jack connector slice 10SL and the plug connector slice 20SL.

Figure 8:
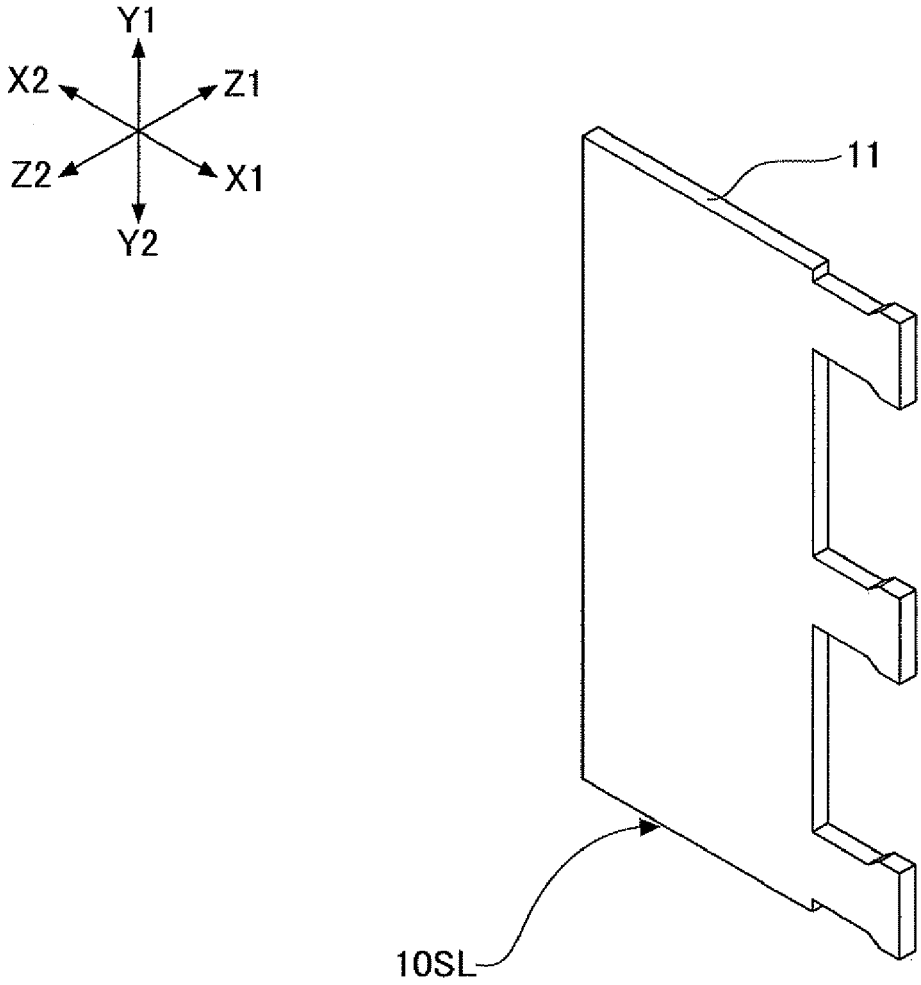
FIG. 8 is an expanded perspective view of a rectangular shaped area R1 indicated by a dotted line in FIG. 3.
Figure 9:
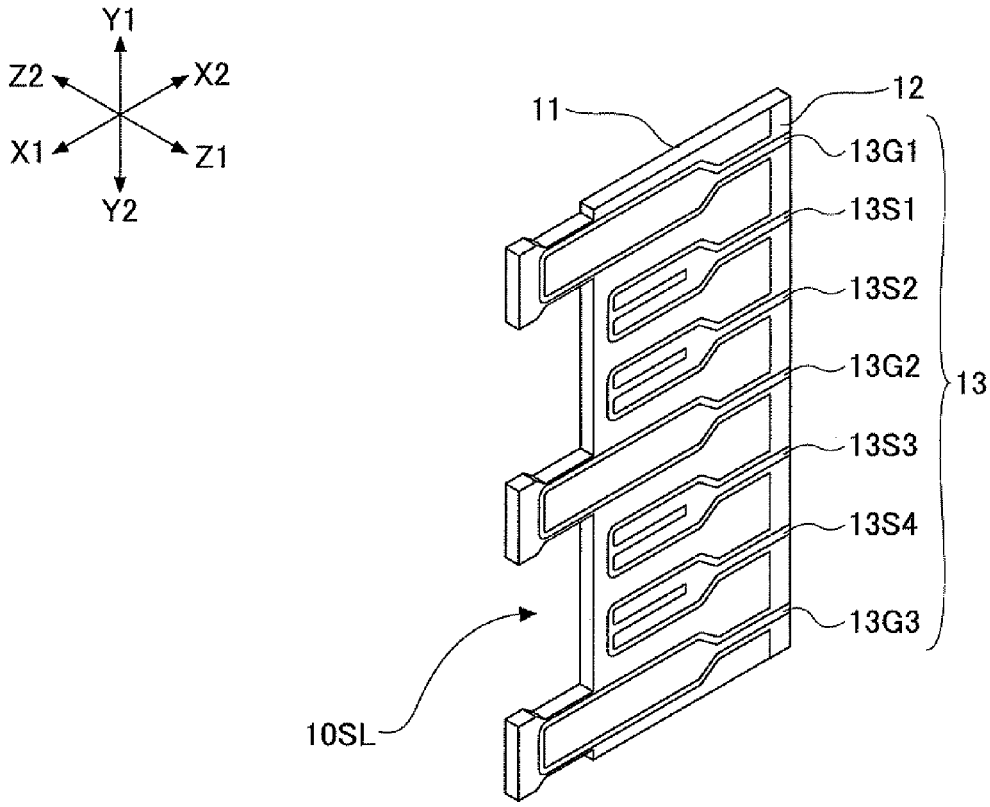
FIG. 9 is a reverse view of the jack connector slice in FIG. 8.
Figure 10:
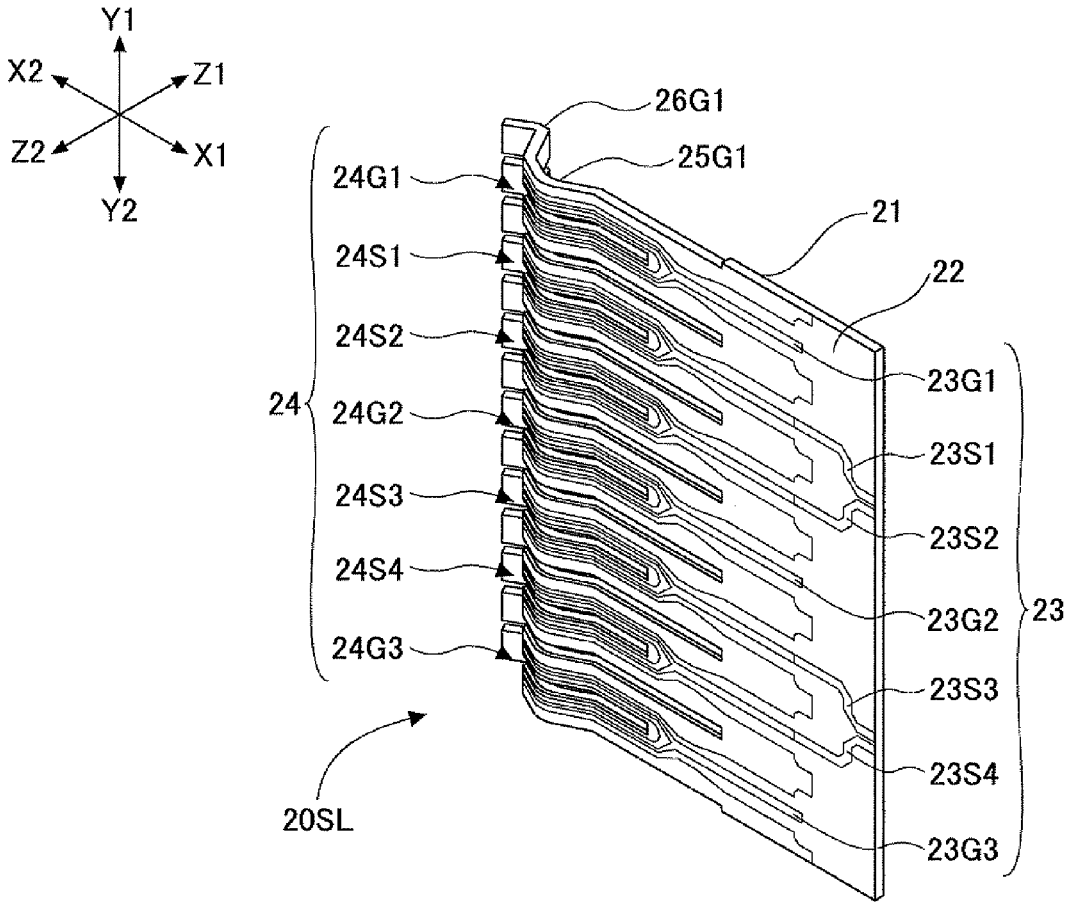
FIG. 10 is an expanded perspective view of a rectangular shaped area R2 indicated by a dotted line in FIG. 5.

FIG. 8 is an expanded perspective view of a rectangular shaped area R1 indicated by a dotted line in FIG. 3, where a direction of the rectangular shaped area R1 is changed. FIG. 9 is a reverse view of the jack connector slice in FIG. 8. FIG. 10 is an expanded perspective view of a rectangular shaped area R2 indicated by a dotted line in FIG. 5, where a direction of the rectangular shaped area R2 is changed.

Figure 11:
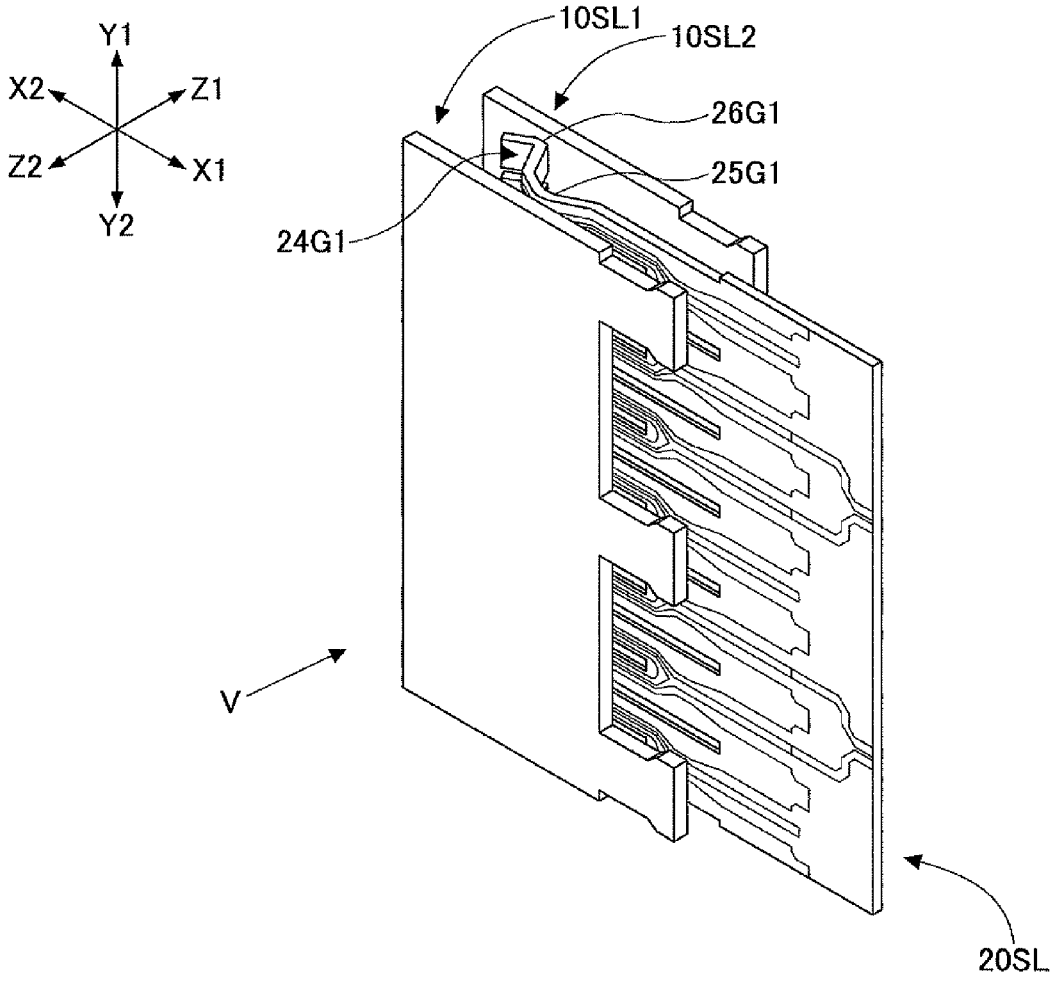
FIG. 11 is an expanded perspective view of a rectangular shaped area R3 indicated by a dotted line in FIG. 7.

FIG. 11 is an expanded perspective view of a rectangular shaped area R3 indicated by a dotted line in FIG. 7, where a direction of the rectangular shaped area R3 is changed. FIG. 11 shows the following state. That is, neighboring two jack connector slices 10SL1 and 10SL2 are arranged with a gap in a Z1-Z2 direction. A single plug connector slice 20SL is inserted between the neighboring two jack connector slices 10SL1 and 10SL2.

As shown in FIG. 8 and FIG. 9, the jack connector slice 10SL includes a conductive board 11, an insulation layer 12, and a conductive pattern 13. The conductive board 11 has a planar-plate shaped configuration and extends in X and Y directions. A pattern of the conductive layer 12 is formed at a Z1 side of the conductive board 11. A conductive pattern 13 is formed at a Z1 side of the insulation layer 12.

The conductive board 11 is formed by, for example, stamping a plate. The insulation layer 12 is formed by, for example, impregnating the conductive board 11 with insulation resin or adhering the insulation resin by insert molding.

The conductive pattern 13 includes plural ground patterns 13G (13G1 through 13G3) and signal patterns 13S (1381 through 13S4). The ground patterns are indicated by "13G" in a collective numerical reference manner of the ground patterns 13G1 through 13G3. This manner is applied to the signal patterns 13S, the ground patterns 23G, the signal patterns 23S, the contacts 24S and 245G, the curved parts 25S and 25G, the head end parts 26S and 26G, and others.

The conductive patterns 13 are provided with gaps in the Y1-Y2 direction in a manner where a pair of signal patterns is sandwiched by two ground patterns. For example, a pair of signal patterns 13S1 and 13S2 is provided between two ground patterns 13G1 and 13G2. Similarly, a pair of signal patterns 13S3 and 13S4 is provided between two ground patterns 13G2 and 13G3.

In addition, as shown in FIG. 10, the plug connector slice 20SL, similar to the jack connector slice 10SL, includes a conductive board 21, an insulation layer 22, and a conductive pattern 23. The conductive board 21 has a plane plate shaped configuration and extends in X and Y directions. A pattern of the insulation layer 22 is formed at a Z2 side of the conductive board 21. A conductive pattern 23 is formed at a Z2 side of the insulation layer 22.

The conductive pattern 23, similar to the conductive pattern 13 of the jack connector slice 10SL, includes plural ground patterns 23G (23G1 through 23G3) and signal patterns 23S (23S1 through 23S4).

Furthermore, the conductive patterns 23 are provided with gaps in the Y1-Y2 direction in a manner where a pair of signal patterns 23S is sandwiched by two ground patterns 23G. For example, a pair of signal patterns 23S1 and 23S2 is provided between two ground patterns 23G1 and 23G2. Similarly, a pair of signal patterns 23S3 and 23S4 is provided between two ground patterns 23G2 and 23G3.

In addition, the plug connector slice 20SL includes plural contacts 24. Each of the contacts 24 extends from an edge part at the X2 side in the X2 direction and has a bifurcated head end. The contact 24 functions as a plate spring. The contact 24 includes plural ground contacts 24G (24G1 through 24G3) and plural signal contacts 24S (24S1 through 24S4).

The contacts 24 are provided with gaps in the Y1-Y2 direction in a manner where a pair of signal contacts 24S is sandwiched by two ground contacts 24G. For example, a pair of signal contacts 24S1 and 24S2 is provided between two ground contacts 24G1 and 24G2. Similarly, a pair of signal contacts 24S3 and 24S4 is provided between two ground contacts 24G2 and 24G3.

The conductive patterns 23 of the plug connector slice 20SL are provided so as to be connected to the corresponding conductive patterns 13 of the jack connector slice 10SL via the corresponding contacts 24. Under the bifurcated head end structure of the contacts 24, by improving flexibility and independent operability of the head end, contact between the conductive patterns 13 and the conductive patterns 23 can be secured. For example, even if the jack connector slice 10SL or the plug connector slice 20SL is deformed relative to the XY plane surface, as long as contact by at least one of the bifurcated head ends is secured, it is possible to maintain the connection between the conductive pattern 13 and the conductive pattern 23.

If the jack connector slice 10SL and the plug connector slice 20SL are connected to each other, as shown in FIG. 11, the contact 24 makes a curved part 25 (25G1) projecting in the Z2 direction contact the conductive pattern 13 (13G1) of the jack connector slice 10SL1 neighboring in the Z2 direction, and makes a head end part 26 (26G1) projecting in the Z2 direction and also Z1 direction contact the conductive board 11 of the jack connector slice 10SL2 neighboring in the Z2 direction.

In the contact 24, an end part of the head end part 26 is bent in the Z2 direction so as to project, and thereby the contact between the head end part 26 and the conductive board 11 of the jack connector slice 10SL2 is smoothly made. More specifically, while a designated angle (for example, approximately 30 degrees) is formed between the end part of the head end part 26 and the conductive board 11, the end part of the head end part 26 projects in the Z2 direction slightly (for example, approximately 0.6 mm).

As discussed below with reference to FIG. 13, between the end part of the head end part 26 and an inflection point of the curved part 25 of the contact 24 (a part where the conductive pattern 13 and the conductive pattern 23 come in contact with each other), the insulation layer 22 and the conductive pattern 23 are not provided but only the conductive board 21 is provided.

Figure 12:
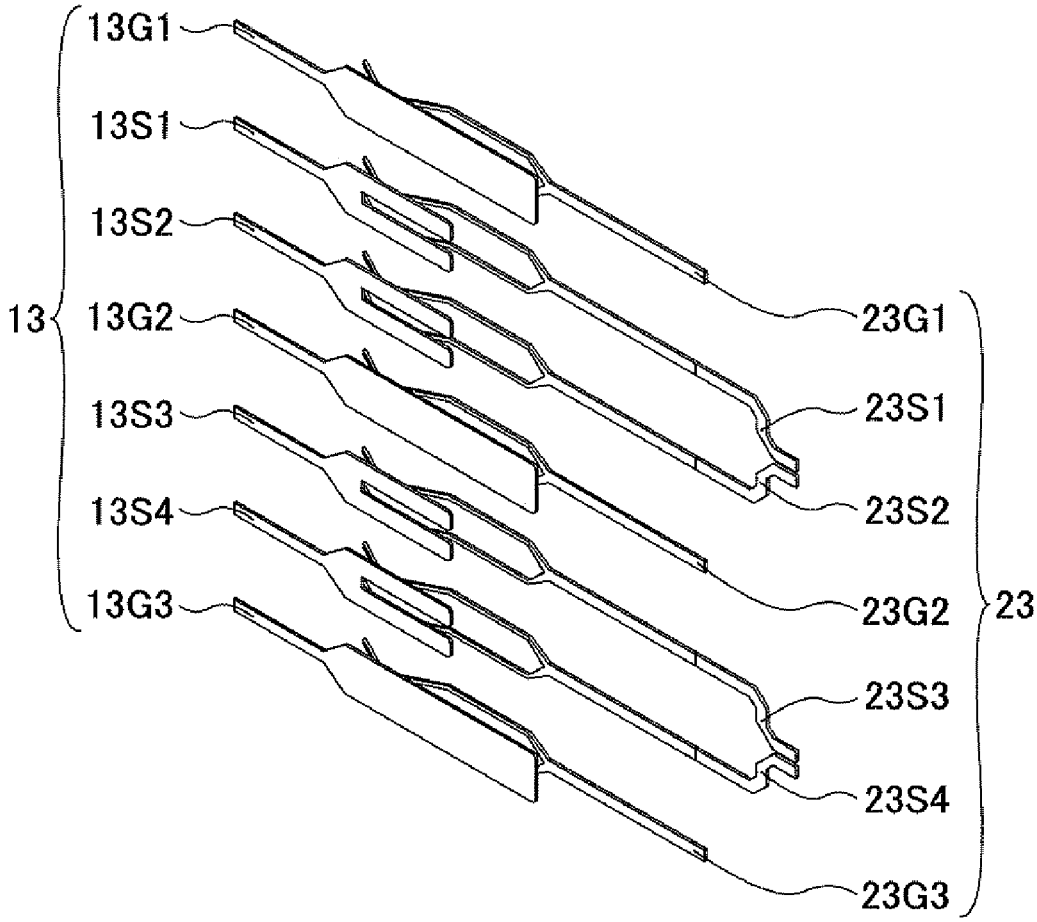
FIG. 12 is a view showing a connecting relationship between conductive patterns of the jack connector slice and conductive patterns of the plug connector slice.

FIG. 12 is a view showing a connecting relationship between conductive patterns 13 of the jack connector slice 10SL and conductive patterns 23 of the plug connector slice 20SL. In FIG. 12, illustrations of the conductive board 11 and the insulation layer 12 of the jack connector slice 10SL and the conductive board 21 and the insulation layer 22 of the plug connector slice 20SL shown in FIG. 11 are omitted.

Figure 13:
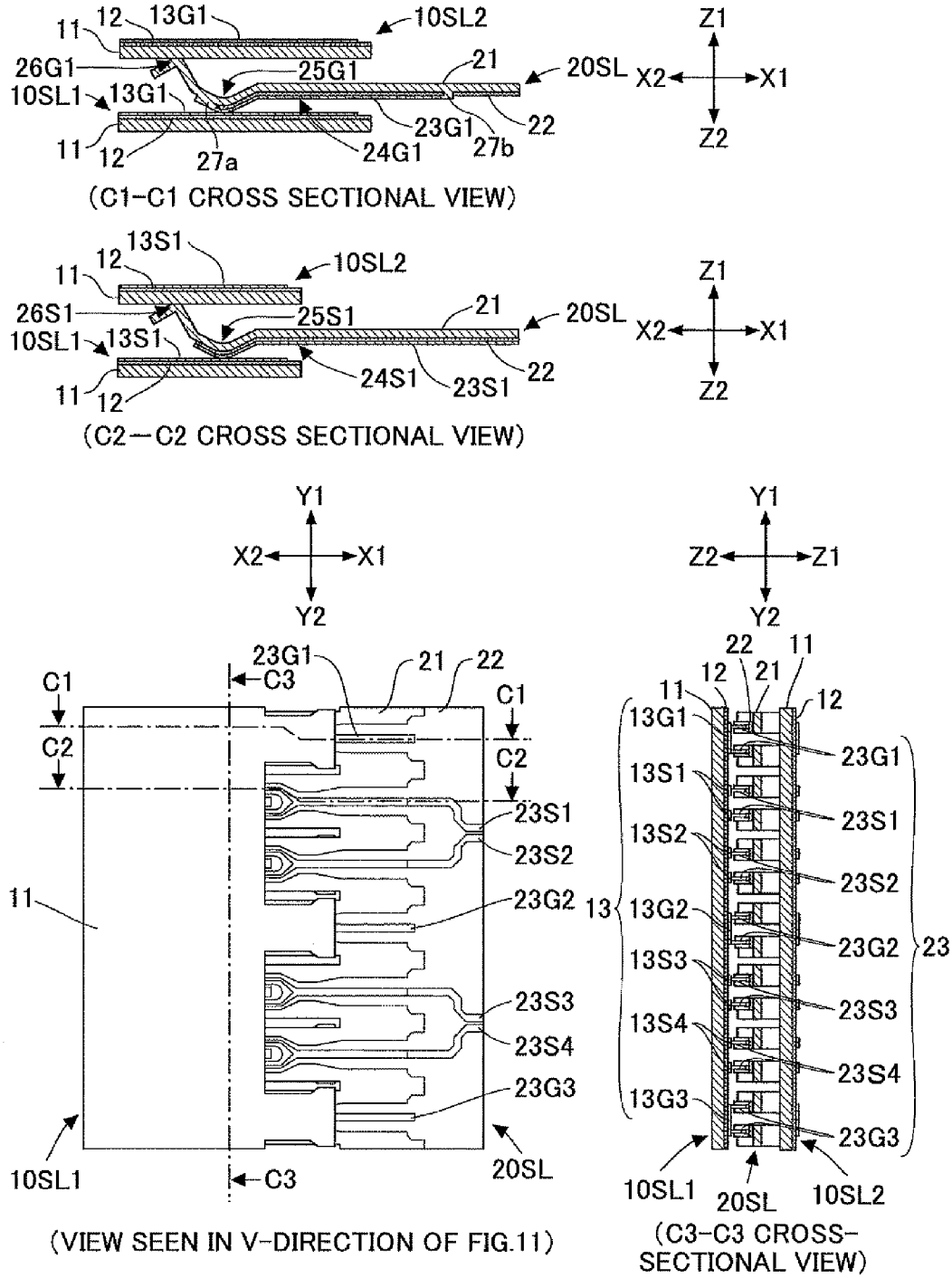
FIG. 13 is a view of combinations of FIG. 11 seen in various directions.

FIG. 13 is a view of combinations of FIG. 11 seen in various directions and shows the connecting relationship between neighboring two jack connector slices 10SL1 and 10SL2 and the plug connector slice 20SL. FIG. 13 includes a view seen in the V direction in FIG. 11, a cross-sectional view taken along a line C1-C1, a cross-sectional view taken along a line C2-C2, and a cross-sectional view taken along a line C3-C3.

The cross-sectional view taken along the line C1-C1 shows a state where the ground pattern 23G1 of the plug connector slice 20SL and the ground pattern 13G1 of the jack connector slice 10SL1 come in contact with each other at the curved part 25G1 of the ground contact 24G1 of the plug connector slice 20SL, and the conductive board 21 of the plug connector slice 20SL and the conductive board 11 of the jack connector slice 10SL2 come in contact with each other at the head end part 26G1 of the ground contact 24G1 of the plug connector slice 20SL. The conductive board 21 of the plug connector slice 20SL and the ground pattern 23G1 are connected to each other via vias 27*a* and the 27*b*.

The cross-sectional view taken along the line C2-C2 shows a state where the signal pattern 23S1 of the plug connector slice 20SL and the signal pattern 13S1 of the jack connector slice 10SL1 come in contact with each other at the curved part 25S1 of the ground contact 24S1 of the plug connector slice 20SL, and the conductive board 21 of the plug connector slice 20SL and the conductive board 11 of the jack connector slice 10SL2 come in contact with each other at the head end part 26S1 of the signal contact 24S1 of the plug connector slice 20SL.

As shown in the cross-sectional view taken along the line C1-C1 and the cross-sectional view taken along the line C2-C2, between the end part of the head end part 26 of the contact 24 and an inflection point of the curved part 25 of the contact 24 (a part where the conductive pattern 13 and the conductive pattern 23 come in contact with each other), the insulation layer 22 and the conductive pattern 23 are not provided but only the conductive board 21 is provided.

The cross-sectional view taken along the line C3-C3 shows a state where the conductive pattern 23 of the plug connector slice 20SL and the conductive pattern 13 of the jack connector slice 10SL1 come in contact with each other at the curved part 25 of the contact 24 of the plug connector slice 20SL, and the conductive board 21 of the plug connector slice 20SL and the conductive board 11 of the jack connector slice 10SL2 come in contact with each other at the head end part 26 of the contact 24 of the plug connector slice 20SL.

According to the above-discussed structure of the connector 100, in a case where the jack connector slice 10SL and the plug connector slice 20SL are connected to each other, the head end part 26S of the signal contact 24S of the plug connector slice 20SL comes in contact with the conductive board 11 of the jack connector slice 10SL. It is possible to prevent the signal contact 24S from functioning as an unnecessary long ground stub.

In the connector 100, the head end part 26S of the signal contact 24S of the plug connector slice 20SL positioned in a most deep layer in the Z1 direction (eighth layer seen from the Z2 side) is made to come in contact with an independent conductive plate, instead of the conductive board 11 of the jack connector slice 10SL. This is because the plug connector slice 20SL is not provided in the SZ1 direction and there is no need to arrange the jack connector slice 10SL.

Figure 14:
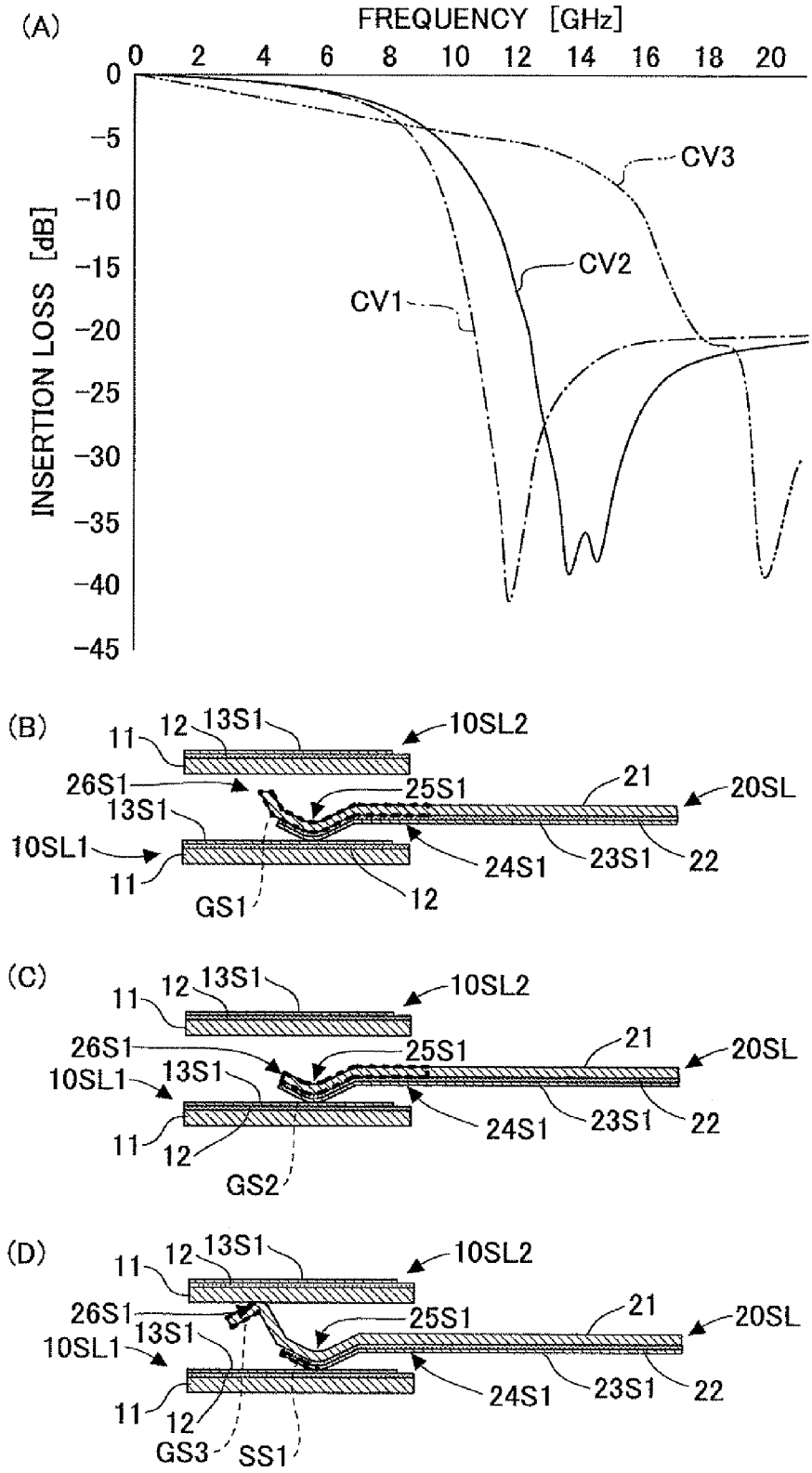
FIG. 14 is a view showing a relationship between a contact configuration of the connector and transition of insertion loss relative to a signal frequency.

Here, a reduction effect of insertion loss of the connector 100 due to a configuration of the contact 24 is discussed with reference to FIG. 14. FIG. 14(A) is a graph showing transition (simulation result) of the insertion loss relative to a signal frequency of the connector wherein a frequency [GHz] of a signal passing through the conductive pattern 13 and the conductive pattern 23 is indicated at a horizontal axis and the insertion loss [dB] is indicated at a vertical axis. Three curves CV1 through CV3 corresponding to contact configurations of three kinds of the connectors are indicated in this graph.

In addition, FIG. 14(B) is a view corresponding to the C2-C2 cross-sectional view in FIG. 13 and shows a contact configuration of the connector providing the curve CV1. Similarly, FIG. 14(C) shows a contact configuration of the connector providing the curve CV2. FIG. 14(D) shows a contact configuration of the connector providing the curve CV3. The contact configuration of the connector 100 corresponds to the contact configuration of the connector shown in FIG. 14(D).

In the contact configuration of the connector shown in FIG. 14(B) and FIG. 14(C), the signal contact 24S of the plug connector slice 20SL does not come in contact with the conductive board 11 of the neighboring jack connector slice 10SL2. Therefore, the ground stubs GS1 and GS2 having lengths indicated by a dotted area are formed.

As a result of this, as shown in FIG. 14(A), in the curve CV1 caused by a structure shown in FIG. 14(B) forming a relatively long ground stub GS1, compared to the curve CV2 caused by a structure shown in FIG. 14(C) forming a relatively short ground stub GS2, a peak of the insertion loss is formed at lower frequency band. While a peak of the insertion loss of the curve CV1 is in the vicinity of 12 GHz, a peak of the insertion loss of the curve CV2 is in the vicinity of 14 GHz.

On the other hand, as shown in FIG. 14(D), the signal contact 24S of the plug connector slice 20SL of the connector 100 comes in contact with the conductive board 11 of the neighboring jack connector slice 10SL2. Therefore, a long ground stub having a contact configuration shown in FIG. 14(B) and FIG. 14(C) is not formed. An extremely short ground stub GS3 and an extremely short stub (hereinafter "signal stub") SS1 indicated by a dotted line in FIG. 14(D) are formed.

The ground stub GS3 and the signal stub SS1 are much shorter than the ground stubs GS1 and GS2 of the connector shown in FIG. 14(B) and FIG. 14(C). As a result of this, as shown in FIG. 14(A), in the curve CV3 caused by a structure shown in FIG. 14(C), compared to the curve CV1 caused by a structure shown in FIG. 14(B) forming a relatively long ground stub GS1 and the curve CV2 caused by a structure shown in FIG. 14(C) forming a relatively long ground stub GS2, a peak of the insertion loss is formed at higher frequency band (in the vicinity of 20 GHz).

The signal stub SS1 is much shorter than the ground stubs GS1 and GS2 in the contact configuration shown in FIG. 14(B) and FIG. 14(C). Therefore, although it is not clearly shown in FIG. 14(B) and FIG. 14(C), the signal stub SS1 is provided in the connectors shown in FIG. 14(B) and FIG. 14(C).

According to the above-discussed structure of the connector 100, in a case where the jack connector slice 10SL and the plug connector slice 20SL are connected to each other, the signal contact 24S is prevented from functioning as an unnecessarily long ground stub. A peak of the insertion loss can be moved to the high frequency side and signal transmission at higher frequency bands can be made.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority or inferiority of the invention. Although the embodiments of the present invention have been described in detail, it should be understood that the various changes, substitutions, and alterations could be made hereto without departing from the spirit and scope of the invention.

For example, in the above-discussed embodiment, the jack connector slice 10SL and the plug connector slice 20SL are formed of the rigid boards. However, the jack connector slice 10SL and the plug connector slice 20SL may be formed of a flexible print board or a rigid flexible board.

In the above-discussed embodiment, the jack connector slice 10SL has a three layer structure formed of the conductive board 11, the insulation layer 12, and the conductive pattern 13. The jack connector slice 10SL may have a structure where an independent conductive board 11 and a board having a two layer structure formed of the insulation layer 12 and the conductive pattern 13 are separately provided. In this case, a gap may be formed in the thickness direction between the independent conductive board 11 and the board having the two layer structure, and the plug connector slice 20SL may be inserted in the gap.

In this case, when the jack connector slice 10SL and the plug connector slice 20SL are connected to each other, the connector 100 makes each of the conductive patterns 23 of the plug connector slice 20SL and the corresponding conductive patterns 13 of the jack connector slice 10SL come in contact with each other at corresponding parts of the curved parts 25 of the contacts 24 of the plug connector slice 20SL. Furthermore, the connector 100 makes the conductive board 21 of the plug connector slice 20SL and the independent conductive board 11 of the jack connector slice 10SL come in contact with each other at the head end part 26 of the contact 24 of the plug connector slice 20SL. The independent conductive board 11 may have a plate-shaped configuration or a pin-shaped configuration.

In this embodiment, the conductive board 11 of the jack connector slice 10SL has a size covering an entire surface of the jack connector slice 10SL. However, the conductive board 11 of the jack connector slice 10SL may have a size smaller than a surface of the jack connector slice 10SL, as long as the contacts 24 do not function as stubs obstructing the transmission of a signal having a predetermined frequency in a case where the jack connector slice 10SL and the plug connector slice 20SL are connected to each other and the head end parts 26 of the contacts 24 of the plug connector slice 20SL come in contact with the conductive board 11.

What is claimed is:

1. A connector, comprising:

a first connector member configured to arrange a plurality of plane first boards with gaps in a thickness direction of the first boards, the first board including a conductive layer and an insulation layer, the insulation layer having a surface where a first signal pattern is formed; and a second connector member configured to arrange a plurality of plane second boards with gaps in a thickness direction of the second boards, the second board including a conductive layer and an insulation layer, the insulation layer having a surface where a second signal pattern is formed;

wherein the first board of the first connector member, by connecting the first connector member and the second connector member to each other, makes the first signal pattern provided on a surface of a contact extending from an edge at a side facing the second connector member toward the second connector member come in contact with the second signal pattern provided on a surface of one of the plural second boards of the second connector member, and makes the conductive layer provided at a head end of the contact come in contact with the conductive layer of another one of the plural second boards.

2. The connector as claimed in claim 1, wherein one of the plural second boards of the second connector member and another one of the plural second boards of the second connector member are provided so as to neighbor with a gap therebetween; and the first board of the first connector member is provided between the one of the plural second boards of the second connector member and the other one of the plural second boards of the second connector member.

3. The connector as claimed in claim 2, wherein the contact includes a curved part projecting toward one of the plural second boards in a state where the first connector member and the second connector member are connected to each other, and a head end part projecting toward another one of the plural second boards in the state where the first connector member and the second connector member are connected to each other, wherein the contact makes the first signal pattern provided on a surface of the curved part come in contact with the second signal pattern provided on a surface of the one of the plural second boards; and the contact makes the conductive layer provided at the head end part come in contact with the conductive layer of the other one of the plural second boards.

4. A connector, comprising:

a first connector member having a plane first board, the first board including a conductive layer and an insulation layer, the insulation layer having a surface where a first signal pattern is formed; and a second connector member having a plane second board and a conductive board, the second board including a conductive layer and an insulation layer, the insulation layer having a surface where a second signal pattern is formed;

wherein the first board of the first connector member, by connecting the first connector member and the second connector member to each other, makes the first signal pattern provided on a surface of a contact extending from an edge at a side facing the second connector member toward the second connector member come in contact with the second signal pattern provided on a surface of the second board of the second connector member, and makes the conductive layer provided at a head end of the contact come in contact with the conductive board of the second connector member.

5. The connector as claimed in claim 4, wherein the second board of the second connector member and the conductive board of the second connector member are provided so as to neighbor with a gap therebetween; and the first board of the first connector member is provided between the second board of the second connector member and the conductive board of the second connector member.

6. The connector as claimed in claim 5, wherein the contact includes a curved part projecting toward the second board in a state where the first connector member and the second connector member are connected to each other, and a head end part projecting toward the conductive board in the state where the first connector member and the second connector member are connected to each other, wherein the contact makes the first signal pattern provided on a surface of the curved part come in contact with the second signal pattern provided on a surface of the second board; and the contact makes the conductive layer provided at the head end part come in contact with the conductive board of the second connector member.

* * * * *